US008297333B2

(12) United States Patent
Meichtry

(10) Patent No.: US 8,297,333 B2
(45) **Date of Patent: *Oct. 30, 2012**

(54) OVERHEAD DOORS AND ASSOCIATED TRACK AND GUIDE ASSEMBLIES FOR USE WITH SAME

(75) Inventor: Michael M. Meichtry, Brookfield, WI (US)

(73) Assignee: 4Front Engineered Solutions, Inc., Carrollton, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/976,807

(22) Filed: Dec. 22, 2010

(65) Prior Publication Data

US 2011/0088327 A1 Apr. 21, 2011

Related U.S. Application Data

(63) Continuation of application No. 12/191,118, filed on Aug. 13, 2008, now Pat. No. 7,891,400.

(60) Provisional application No. 60/956,355, filed on Aug. 16, 2007, provisional application No. 60/956,363, filed on Aug. 16, 2007, provisional application No. 60/956,368, filed on Aug. 16, 2007.

(51) Int. Cl.
*E05D 15/00* (2006.01)

(52) U.S. Cl. ..... 160/210; 160/205

(58) Field of Classification Search ..... 160/181, 160/201, 205, 273.1, 274, 276, 264, 280, 160/281, 282, 285, 288
See application file for complete search history.

(56) References Cited

U.S. PATENT DOCUMENTS

| | | | |
|---|---|---|---|
| 1,787,451 | A | 1/1931 | Mohun et al. |
| 1,990,870 | A | 2/1935 | Kelly |
| 2,064,470 | A | 12/1936 | Heckman |
| 2,090,146 | A | 8/1937 | Pixley |
| 2,124,969 | A | 7/1938 | Bagley et al. |
| 2,686,926 | A | 8/1954 | Schacht, Jr. et al. |
| 2,839,135 | A | 6/1958 | Anderson |

(Continued)

FOREIGN PATENT DOCUMENTS

WO WO-2008/045037 A2 4/2008

OTHER PUBLICATIONS

"MpactDoor," Aaron-Bradley Company, Inc., 1 page [date unknown].

(Continued)

*Primary Examiner* — Katherine w Mitchell
*Assistant Examiner* — Jamie F Cardenas-Garcia
(74) *Attorney, Agent, or Firm* — Perkins Coie LLP

(57) ABSTRACT

Overhead door assemblies having both interlocking and releasable guide assemblies, and guide track assemblies for use with same are disclosed herein. An overhead door track configured in accordance with an embodiment of the invention includes a first side portion spaced apart from a second side portion to define a channel or gap region therebetween. The first side portion has a first guide surface and a first retention surface. Similarly, the second side portion has a second guide surface and a second retention surface. In this embodiment, the first and second guide surfaces diverge outwardly from the gap region in a first direction, and the first and second retention surfaces diverge inwardly from the gap region in a second direction, opposite the first direction. An overhead door configured in accordance with another embodiment of the invention can include a first guide member configured to extend through the gap region and movably engage the first and second retention surfaces, and a second guide member configured to be removably engaged with the first and second guide surfaces.

20 Claims, 9 Drawing Sheets

U.S. PATENT DOCUMENTS 2,929,115 A 3/1960 Beckstrom
3,140,508 A 7/1964 Switzgable
3,188,698 A 6/1965 Zoll et al.
3,336,968 A 8/1967 Curtis
3,345,677 A 10/1967 Milette
3,484,812 A 12/1969 Holland
3,552,474 A 1/1971 Finnegan
3,693,693 A 9/1972 Court
3,928,889 A 12/1975 Wartian
3,934,635 A 1/1976 Kin
4,016,920 A 4/1977 Shepard
4,080,757 A 3/1978 Westerman
4,120,072 A 10/1978 Hormann et al.
4,149,295 A 4/1979 Owen
4,155,268 A 5/1979 Lee et al.
4,205,713 A 6/1980 Galbreath
4,352,585 A 10/1982 Spalding
4,379,479 A 4/1983 Whiting
4,478,268 A 10/1984 Palmer et al.
4,572,268 A 2/1986 Wentzel
4,601,320 A 7/1986 Taylor et al.
4,676,293 A 6/1987 Hanssen
4,800,618 A 1/1989 Putz
4,836,589 A 6/1989 Mohr
4,846,245 A 7/1989 Pagliaro et al.
4,894,888 A 1/1990 Bassouls
4,934,835 A 6/1990 Albert et al.
5,036,899 A 8/1991 Mullet
5,058,651 A 10/1991 Ashley et al.
5,131,450 A 7/1992 Lichy
5,141,043 A 8/1992 Kraeutler et al.
5,163,495 A 11/1992 Lichy
5,219,015 A 6/1993 Kraeutler
5,222,541 A 6/1993 Hornberger
5,240,216 A 8/1993 Lin et al.
5,271,448 A 12/1993 Delgado
5,291,686 A 3/1994 Sears et al.
5,299,617 A 4/1994 Hying et al.
5,307,855 A 5/1994 Martensson, IV
5,351,742 A 10/1994 Lichy
5,353,473 A 10/1994 Sherick
5,353,859 A 10/1994 Oltahfer et al.
5,365,993 A 11/1994 Jella
5,367,825 A 11/1994 Doring et al.
5,368,084 A 11/1994 Hying et al.
5,404,927 A 4/1995 Bailey
5,408,724 A 4/1995 Mullet et al.
5,409,051 A 4/1995 Mullet et al.
5,445,207 A 8/1995 Romanelli et al.
5,447,377 A 9/1995 Baumgartner et al.
5,477,902 A 12/1995 Kraeutler
5,522,446 A 6/1996 Mullet et al.
5,533,561 A 7/1996 Forehand, IV
5,535,805 A 7/1996 Kellogg et al.
5,562,141 A 10/1996 Mullet et al.
5,566,740 A 10/1996 Mullet et al.
5,568,672 A 10/1996 Mullet et al.
5,584,333 A 12/1996 Torchetti et al.
5,601,133 A 2/1997 Krupke et al.
5,620,039 A 4/1997 Delgado et al.
5,638,883 A 6/1997 Schulte
5,659,926 A 8/1997 Dietrich
5,718,533 A 2/1998 Mullet et al.
5,720,332 A 2/1998 Nachreiner
5,727,614 A 3/1998 Lichy
5,737,802 A 4/1998 Jella
5,743,317 A 4/1998 Beringer et al.
5,765,622 A 6/1998 Lichy
5,829,504 A 11/1998 Ekstrand et al.
5,887,385 A 3/1999 Horner et al.
5,927,368 A 7/1999 Rohrer et al.
5,927,862 A 7/1999 Debnam et al.
5,944,086 A 8/1999 Gruben et al.
5,946,869 A 9/1999 Zinbarg
5,954,111 A 9/1999 Ochoa
5,957,187 A 9/1999 Gruben et al.
5,992,497 A 11/1999 Jaehnen et al.
6,035,918 A 3/2000 Kraeutler
6,039,106 A 3/2000 Gontarski et al.
6,041,844 A 3/2000 Kellogg et al.
6,047,761 A 4/2000 Jaehnen et al.
6,068,040 A 5/2000 Magro et al.
6,076,590 A 6/2000 Ford et al.
6,082,430 A 7/2000 Mock
6,089,304 A 7/2000 Mullet et al.
6,089,305 A 7/2000 Gruben et al.
6,094,779 A 8/2000 Young
6,095,229 A 8/2000 Kellogg et al.
6,112,464 A 9/2000 Grisham et al.
6,112,799 A 9/2000 Mullet et al.
6,119,307 A 9/2000 Weishar et al.
6,125,506 A 10/2000 Martin
6,148,897 A 11/2000 Horner et al.
6,185,783 B1 2/2001 Carpinella
6,227,281 B1 5/2001 Martin
6,250,360 B1 6/2001 Ochoa
6,263,948 B1 7/2001 Whitley
6,273,175 B1 8/2001 Kellogg et al.
6,315,027 B1 11/2001 Lichy
6,321,822 B1 11/2001 Horner et al.
6,434,886 B1 8/2002 Johnson et al.
6,463,988 B1 10/2002 Mullet et al.
6,481,487 B2 11/2002 Simon et al.
6,527,035 B2 3/2003 Hoofard et al.
6,536,077 B1 3/2003 Espey
6,540,003 B1 4/2003 Martin
6,554,047 B1 4/2003 Mondragon et al.
6,574,832 B1 6/2003 Boerger et al.
6,588,482 B2 7/2003 Wright
6,598,648 B1 7/2003 Schulte
6,612,357 B1 9/2003 Beringer et al.
6,615,898 B2 9/2003 Schulte
6,640,496 B2 11/2003 Mullet
6,640,872 B1 11/2003 Mullet
6,644,378 B2 11/2003 Mitchell
6,655,442 B2 12/2003 Snyder
6,659,158 B2 12/2003 Laugenbach et al.
6,698,490 B2 3/2004 Hoerner et al.
6,715,236 B2 4/2004 Mullet
6,715,531 B2 4/2004 Simon et al.
6,729,380 B2 5/2004 Whitley et al.
6,739,372 B2 5/2004 Mullet et al.
6,745,814 B2 6/2004 Hoofard et al.
6,792,998 B2 9/2004 David
6,840,300 B2 1/2005 Lewis, Jr.
6,843,300 B2 1/2005 Mullet et al.
6,918,157 B2 7/2005 Koike et al.
6,951,237 B2 10/2005 Mullet
6,964,289 B2 11/2005 Schulte
7,011,347 B2 3/2006 Finardi
7,036,548 B2 5/2006 Johnston et al.
7,055,571 B2 6/2006 Johnston et al.
7,089,990 B2 8/2006 Hormann et al.
7,114,291 B2 10/2006 David
7,114,753 B2 10/2006 Nodorft
7,117,916 B2 10/2006 Johnston et al.
7,128,123 B2 10/2006 Mullet et al.
7,721,387 B1 5/2010 Mullet et al.
2009/0044453 A1 2/2009 Meichtry
2009/0044454 A1 2/2009 Meichtry
2009/0044917 A1 2/2009 Meichtry

OTHER PUBLICATIONS

"MpactDoor—Panel Features and General Specifications," Aaron-Bradley Company, Inc., 1 page, published 2008.

Material Handling Engineering, Mar. 1995, "A Door Built to Take the Punches", p. 19.

Non-Final Office Action; U.S. Appl. No. 12/191,118; Mailing Date:Mar. 5, 2010, 31 pages.

Non-Final Office Action; U.S. Appl. No. 12/191,146; Mailing Date: Aug. 19, 2010, 17 pages.

Non-Final Office Action; U.S. Appl. No. 12/191,140; Mailing Date: Jan. 19, 2011, 27 pages.

OVERHEAD DOORS AND ASSOCIATED TRACK AND GUIDE ASSEMBLIES FOR USE WITH SAME

CROSS-REFERENCE TO RELATED APPLICATIONS

This is a continuation of U.S. application Ser. No. 12/191,118, filed Aug. 13, 2008, now U.S. Pat. No. 7,891,400; which claims priority to U.S. Provisional Application Ser. No. 60/956,355, filed Aug. 16, 2007, the disclosures of which are incorporated herein by reference in their entirety. The disclosures of the following patent applications are also incorporated herein by reference in their entireties: U.S. Provisional Application Ser. No. 60/956,363, filed Aug. 16, 2007; U.S. Provisional Application Ser. No. 60/956,368, filed Aug. 16, 2007; U.S. application Ser. No. 12/191,140, filed Aug. 13, 2008; and U.S. application Ser. No. 12/191,146, filed Aug. 13, 2008.

TECHNICAL FIELD

The following disclosure relates generally to overhead doors and, more particularly, to overhead door tracks and associated guide assemblies.

BACKGROUND

Overhead doors have been used on loading docks and in various other warehouse and factory settings for many years. Conventional overhead doors are of the sectional type, and typically include four or more rectangular panels hinged together along the upper and lower edges. Each of the door panels carries two guide assemblies near the upper hinge line, and the bottom door panel usually carries two additional guide assemblies near the bottom edge. Each of the guide assemblies typically includes a plunger or roller device that extends outwardly from the door panel and is movably received in a channel of an adjacent door track. The door tracks extend along the left and right sides of the door, and guide the door as it moves upwardly into the overhead or "open" position.

Conventional overhead doors are susceptible to damage when used in factories, warehouses, and other commercial and industrial settings. Occasionally, for example, a forklift operator may inadvertently run into the door, as can happen when the door is in a partially open position. This can damage the door and/or the door tracks, making further use of the door difficult or impossible without time-consuming repairs. One way to overcome this problem is to equip the door with spring-loaded guide assemblies that can retract and release from the tracks when struck with sufficient force in one or more directions, as disclosed in, for example, U.S. Pat. No. 5,535,805 to Kellog, et al., U.S. Pat. No. 5,927,368 to Rohrer, et al., U.S. Pat. No. 6,041,844 to Kellog, et al., U.S. Pat. No. 6,095,229 to Kellog, et al., U.S. Pat. No. 6,119,307 to Weishar, et al., and U.S. Pat. No. 6,273,175 to Kellog, et al. (All of the foregoing patents are incorporated into the present disclosure in their entireties by reference).

Although configuring the door to release in one or both directions may avoid damage to the door when struck, this approach can present additional problems. For example, under certain conditions the entire door could be knocked out of the tracks, and reinstalling an entire door can be a difficult and time-consuming task. Furthermore, one or more spreader bars may be necessary to help hold the overhead door tracks in position.

SUMMARY

The following summary is provided for the benefit of the reader only, and is not intended to limit the invention as set forth by the claims in any way.

The present disclosure is directed generally to overhead door track and guide assemblies. An overhead door track configured in accordance with one aspect of the invention includes a first side portion spaced apart from a second side portion to define a gap region therebetween. The first side portion has a first guide surface and a first retention surface. Similarly, the second side portion has a second guide surface and a second retention surface. In this aspect of the invention, the first and second guide surfaces diverge from the gap region toward a first direction, and the first and second retention surfaces diverge from the gap region toward a second direction, opposite the first direction. In one embodiment of the invention, the gap region between the first and second side portions is configured to movably receive an overhead door guide member.

An overhead door configured in accordance with another aspect of the invention includes a first door panel having a bottom edge extending between a first side edge and a second side edge, and a second door panel having a top edge extending between a third side edge and a fourth side edge. The top edge of the second door panel is hingably attached to the bottom edge of the first door panel. The overhead door can further include a first guide assembly attached to the first door panel proximate to the first side edge, and a second guide assembly attached to the second door panel proximate to the third side edge. In this aspect of the invention, the first guide assembly includes a first guide member having a first head portion configured to be movably received by the guide track, and the second guide assembly includes a second guide member having a second head portion configured to be movably received by the guide track. The first head portion of the first guide member is spaced apart from the first side edge of the first door panel by a first offset distance. The second head portion of the second guide member is smaller than the first head portion of the first guide member, and is spaced apart from the third side edge of the second door panel by a second offset distance that is less than the first offset distance. In one embodiment, the first head portion of the first guide member includes an outwardly flared, conical surface, and the second head portion of the second guide member includes a spherical surface.

DETAILED DESCRIPTION

The following disclosure describes overhead door tracks and associated guide assemblies. In one embodiment, for example, an overhead door track has a cross-sectional shape that varies over its length to provide single knock-out (i.e., door release in a single direction), double knock-out (i.e., door release in two directions), and no-knock-out capabilities at different locations along the track to satisfy different functional requirements. Certain details are set forth in the following description and in FIGS. 1-8 to provide a thorough understanding of various embodiments of the invention. Other details describing well-known structures and systems often associated with overhead doors, overhead door tracks, and overhead door guide assemblies, have not been set forth in the following disclosure to avoid unnecessarily obscuring the description of the various embodiments of the invention.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar elements. To facilitate the discussion of any particular element, the most significant digit or digits of any reference number refer to the Figure in which that element is first introduced. For example, element 110 is first introduced and discussed with reference to FIG. 1.

Figure 1:
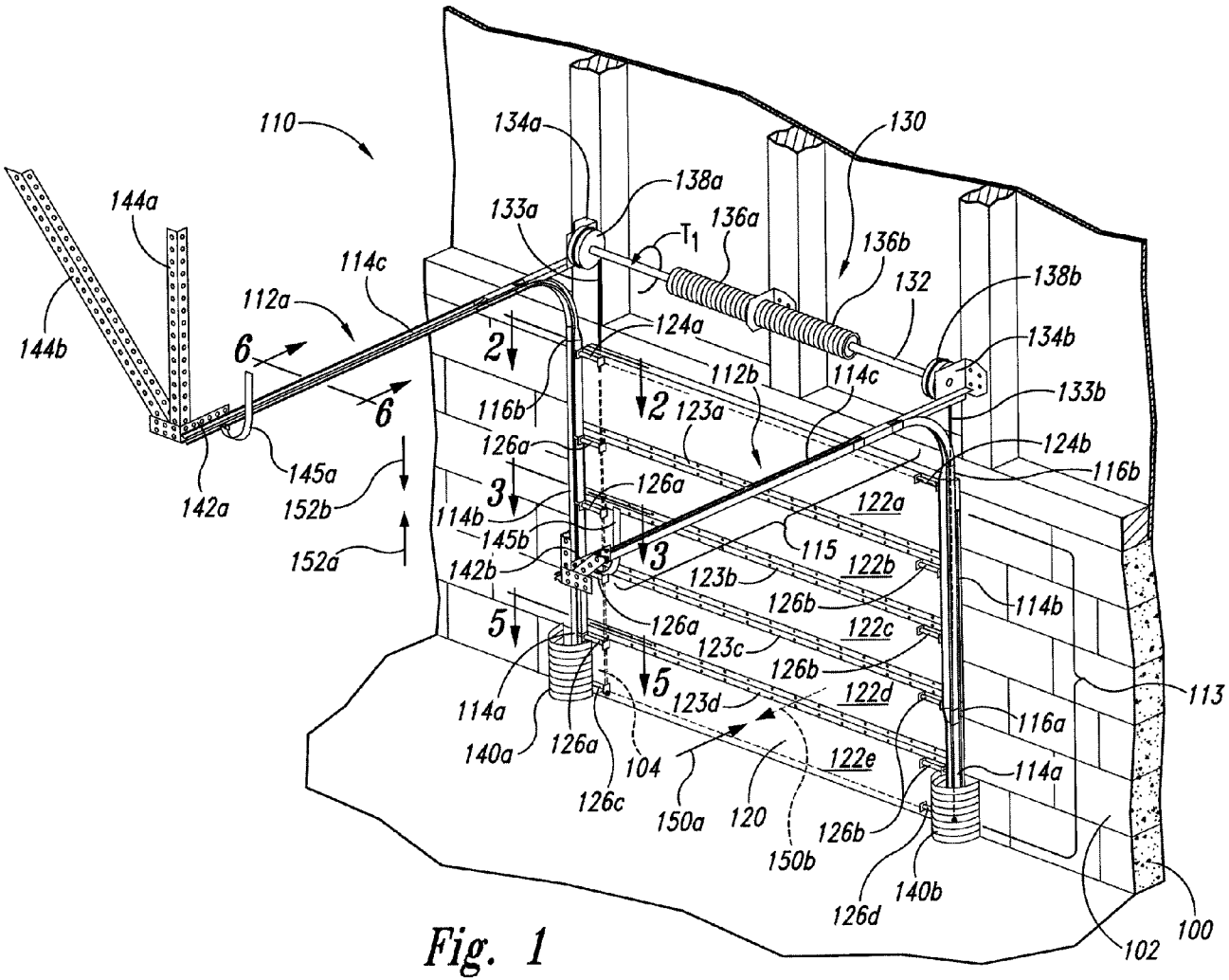
FIG. 1 is an isometric view of an overhead door assembly configured in accordance with an embodiment of the invention.

FIG. 1 is an isometric view of an overhead door assembly 110 configured in accordance with an embodiment of the invention. The overhead door assembly 110 ("door assembly 110") is installed in an opening 104 in a wall 102 of a building 100. The wall 102 can be part of a loading dock at, for example, a warehouse, factory, or other type of commercial building 100. In other embodiments, however, the door assembly 110 can be installed in other types of openings in other types of commercial and non-commercial buildings.

The overhead door assembly 110 includes a sectional door 120 that is movably supported in opposing track assemblies 112 (identified individually as a left or first track assembly 112*a* and a right or second track assembly 112*b*). The sectional door 120 includes a plurality of rectangular door panels 122 (identified individually as door panels 122*a*-*e*) which are pivotally attached to each other along hinge lines 123 (identified individually as hinge lines 123*a*-123*d*). In one aspect of this embodiment, the first door panel 122*a* carries a first interlocking guide assembly 124*a* that movably engages the first track assembly 112*a*, and a second interlocking guide assembly 124*b* that movably engages the second track assembly 112*b*. In contrast, each of the remaining door panels 122*b*-*e* carries a first releasable guide assembly 126*a* that movably engages the first track assembly 112*a* at least proximate to the upper hinge line 123, and a second releasable guide assembly 126*b* that movably engages the second track assembly 112*b* at least proximate to the upper hinge line 123. In addition, the fifth door panel 122*e* carries a third releasable guide assembly 126*c* that movably engages the first track assembly 112*a* at least proximate to a lower edge of the door panel 122*e*, and a fourth releasable guide assembly 126*d* that movably engages the second track assembly 112*b* at least proximate to the lower edge of the door panel 122*e*. In other embodiments, overhead doors configured in accordance with the present disclosure can include other guide assembly arrangements that differ from that illustrated in FIG. 1. For example, in another embodiment, each of the door panels 122*a*-*d* can utilize the interlocking guide assemblies 124, and only the lowermost door panel 122*e* can utilize the releasable guide assemblies 126. In yet another embodiment, all of the door panels 122 can utilize the interlocking guide assemblies 124. Accordingly, the invention is not limited to the particular guide assembly configuration illustrated in FIG. 1.

In one aspect of this embodiment, the interlocking guide assemblies 124 can include an "interlocking" guide member that is retained in the adjacent track section when subjected to a force in an outward or first direction 150*a* or an inward or second direction 150*b*. In contrast, the releasable assemblies 126 can include a "releasable" guide member that disengages from the adjacent track section (thereby allowing the corresponding door panel 122 to be "knocked-out") when subjected to a sufficient force in one or both of the first direction 150*a* and/or the second direction 150*b*. These and other details of the guide assemblies 124 and 126 are described in greater detail below with reference to, for example, FIGS. 2 and 3.

In the illustrated embodiment, each of the track assemblies 112 includes a vertical segment 113 secured to the wall 102, and a non-vertical segment 115 which curves away from the wall 102 above the door opening 104. A guard rail 140, or a similar type of protective structure, can be installed around the lower portion of the vertical track segment 113 to protect it from damage from errant forklifts or other types of impacts. The distal ends of the non-vertical track segments 115 can be attached to an overhead support system 144 via a backhang bracket 142. The support system 144 can include a vertical member 144*a* and a diagonal member 144*b* having distal ends that are fixedly attached to adjacent building structures for support. A door bumper 145, made of spring steel or other suitable material, can be fixedly attached near the distal end of each of the non-vertical track segments 115 to absorb the kinetic energy of the door 120 as it moves to the overhead position.

Each of the track assemblies 112 includes a plurality of track sections 114 (identified individually as track sections 114*a*-114*c*) operably coupled together in functional alignment via a first transition section 116*a* and a second transition section 116*b*. In one aspect of this embodiment, each of the track sections 114*a*-*c* has a different cross-sectional shape that provides different door knock-out capabilities at different locations along the track. For example, in the illustrated embodiment, the cross-sectional shape of the first track section 114*a* allows the releasable guide assemblies 126 to disengage from the track section 114*a* when subjected to a force of a predetermined magnitude in the first direction 150*a*. This same cross-sectional shape, however, does not allow the releasable guide assemblies 126 to disengage from the first track section 114*a* when subjected to a force in the opposite, second direction 150*b*.

Turning now to the second track section 114*b*, this track section has a cross-sectional shape that allows the releasable guide assemblies 126 to disengage when subjected to a force of sufficient magnitude in either the first direction 150*a* or the second direction 150*b*. The third track section 114*c* has yet another cross-sectional shape that differs from both the first track section 114*a* and the second track section 114*b*. More specifically, the third track section 114*c* has a cross-sectional shape that retains both the releasable guide assemblies 126 and the interlocking guide assemblies 124 when the door 120 is in the overhead position, even when the door 120 is subjected to a substantial force in an upward or third direction 152*a* or a downward or fourth direction 152*b*. These and other features of the track sections 114 are described in greater detail below with reference to FIGS. 2-6B.

In a further aspect of this embodiment, the overhead door assembly 110 also includes a counter balance system 130 fixedly attached to the building 100 above the door opening 104. The counter balance system 130 can include a first cable 133*a* and a second cable 133*b* which are attached to the lower-most door panel 122*e*. The counter balance cables 133 may also be attached to other door panels 122 at the top or bottom. Each of the cables 133 is operably coupled to a corresponding cable drum 138 (identified individually as a first cable drum 138*a* and a second cable drum 138*b*). The cable drums 138 are fixedly attached to an axle 132 which is rotatably supported by opposing bearing supports 134*a* and 134*b*. A first coil spring 136*a* and a second coil spring 136*b* are operably wound about the axle 132, and exert a torsional force $T_1$ on the cable drums 138 which is proportional to the amount of cable extension. The torsional force $T_1$ puts the cables 133 in tension, making it easier for a person to lift the door 120 and allowing the door 120 to close or lower at a controlled rate of speed.

In operation, a person wishing to open the door 120 simply grasps the door 120 and lifts. As the door 120 moves upwardly, the door panels 122 curve around the bends in the third track sections 114*c* and move inwardly on the non-vertical track segments 115 toward the bumpers 145. Although not shown in FIG. 1, in an alternate embodiment the overhead door assembly 110 can be equipped with an electric motor or other automated device for opening the door 120. With the door 120 stowed in the overhead position, personnel can transport goods and materials through the opening 104 by forklift, dolly, or other conveyance.

In the embodiment of FIG. 1, the door 120 moves upwardly and then away from the wall 102 in a horizontal direction. In other embodiments, however, an overhead door configured in accordance with the present disclosure can move away from the opening 104 in multiple directions. For example, the door 120 can move along tracks that extend away from the wall 102 at any angle from about 0 degrees (i.e., parallel to the wall 102) to about 90 degrees (i.e., horizontal, as shown in FIG. 1). Accordingly, those of ordinary skill in the relevant art will appreciate that the present invention is not limited to the particular embodiment disclosed in FIG. 1, but extends to other embodiments incorporating the inventive features disclosed herein.

Figure 2:
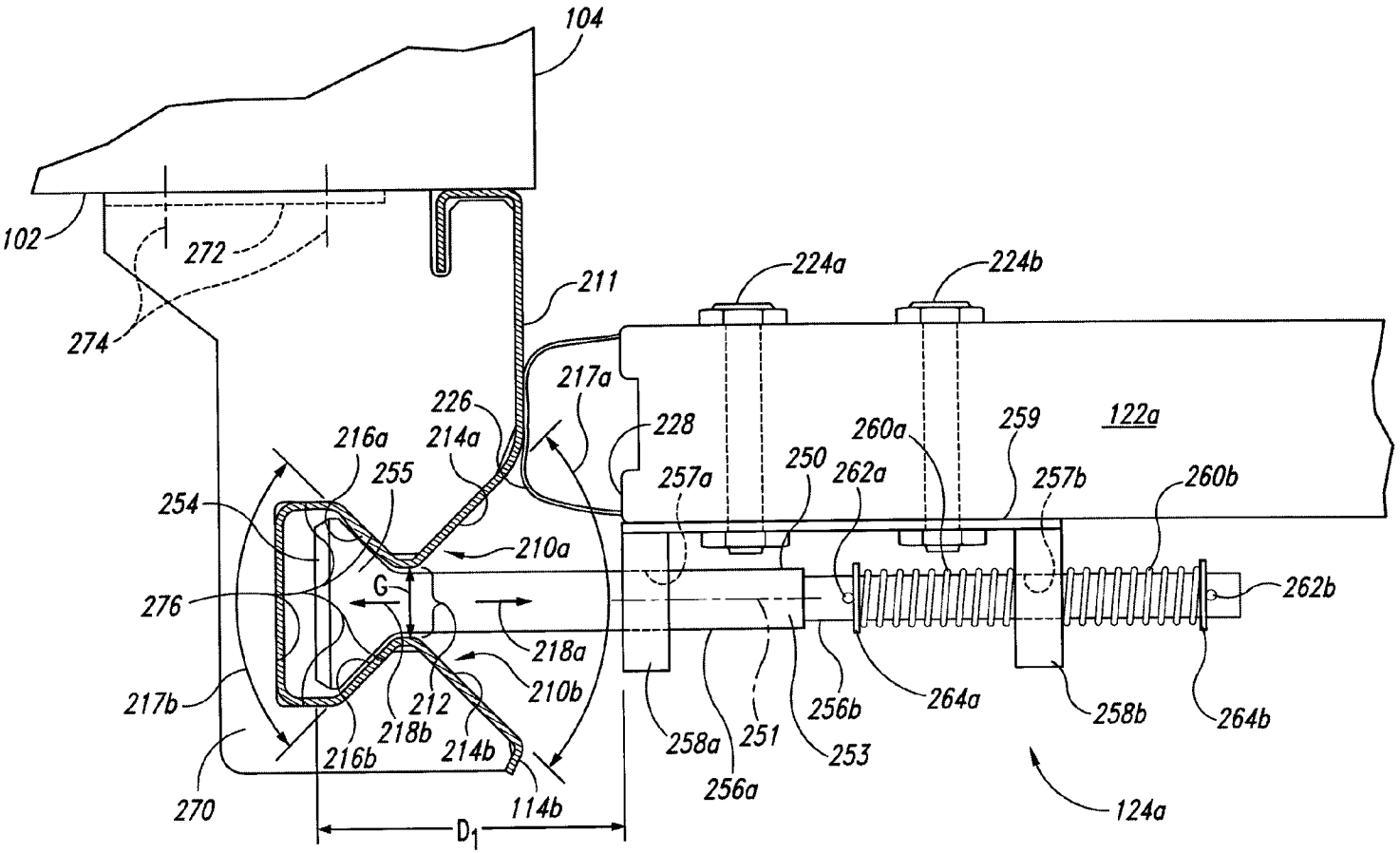
FIG. 2 is an enlarged cross-sectional end view of a track section and guide assembly configured in accordance with an embodiment of the invention.

FIG. 2 is an enlarged, cross-sectional end view taken along line 2-2 in FIG. 1, showing the interlocking guide assembling 124*a* movably engaged with the second track section 114*b* in accordance with an embodiment of the invention. In one aspect of this embodiment, the second track section 114*b* includes a first side portion 210*a* spaced apart from a second side portion 210*b* to define a channel or gap region 212 therebetween. The gap region 212 defines a gap dimension G. The first side portion 210*a* includes a first guide surface 214*a* and a first retention surface 216*a*. Similarly, the second side portion 210*b* includes a second guide surface 214*b* and a second retention surface 216*b*.

The first and second guide surfaces 214 diverge from the gap region 212 in a fifth direction 218*a* to form a first "V-groove," and the first and second retention surfaces 216 diverge from the gap region 212 in a sixth direction 218*b*, opposite to the fifth direction 218*a*, to form a second "V-groove." In the illustrated embodiment, the first guide surface 214*a* is disposed at a first angle 217*a* of from about 60 degrees to about 120 degrees, e.g., about 90 degrees relative to the second guide surface 214*b*. The first retention surface 216*a* can be disposed at a second angle 217*b* of from about 40 degrees to about 180 degrees relative to the second retention surface 216*b*. For example, in one embodiment the first retention surface 216*a* can be disposed at a second angle 217*b* of from about 60 degrees to about 160 degrees, e.g., about 120 degrees relative to the second retention surface 216*b*. As described in greater detail below, however, in other embodiments the first and second guide surfaces 214, and/or the first and second retention surfaces 216, can be disposed at other angles, or parallel, relative to each other.

In addition to the foregoing surfaces, the second track section 114*b* further includes a seal surface 211 extending adjacent to the first guide surface 214*a*. As illustrated in FIG. 2, the first door panel 122*a* carries a compressible seal 226 that slidably contacts the seal surface 211. The seal 226 can be manufactured from rubber, polyurethane, foam, and/or any other suitable material known in the art.

In one embodiment, the track sections 114 can be roll-formed from a suitable sheet metal, such as galvanized steel having a thickness ranging from about 10 gauge to about 20 gauge, e.g. about 16 gauge. In other embodiments, the track sections 114 can be brake- or press-formed from a suitable sheet metal. In further embodiments, the track sections 114, and/or other overhead door track sections embodying the inventive features thereof, can be machined, cast, or otherwise formed from other metallic and non-metallic materials having suitable strength, stiffness, forming, cost, and/or other characteristics. Accordingly, those of ordinary skill in the art will appreciate that aspects of the present invention are not limited to a particular manufacturing method.

In another aspect of this embodiment, the interlocking guide assembly 124*a* includes an interlocking guide member 250 that projects outwardly from a door edge region 228 a distance $D_1$ along a longitudinal axis 251 of the guide member 250 which extends at least approximately parallel to the door panel 122*a*. The interlocking guide member 250 includes a cylindrical shaft 253 having a first shaft portion 256*a* and a smaller-diameter second shaft portion 256*b*. The first shaft portion 256*a* extends through a first aperture 257*a* in a first journal 258*a*. The second shaft portion 256*b* extends from the first shaft portion 256*a* through a coaxial second aperture 257*b* in a second journal 258*b*. The journals 258 are carried by a bracket 259 which is fixedly attached to the first door panel 122*a* by a plurality of bolts 224 or other suitable fasteners and/or methods known in the art.

In a further aspect of this embodiment, the distal end of the first shaft portion 256*a* carries an enlarged head portion 254 that is movably retained by the retention surfaces 216 as the door 120 (FIG. 1) moves relative to the second track section 114*b*. In the illustrated embodiment, the enlarged head portion 254 flares outwardly from the first shaft portion 256*a* to form a reverse conical, or at least generally conical, surface 255. Moreover, the angle of the surface 255 is at least generally similar, or at least approximately parallel, to the angle 217*b* between the adjacent retention surfaces 216. In other embodiments, however, other configurations of interlocking guide members and associated track sections can be employed without departing from the spirit or scope of the present disclosure. For example, in other embodiments consistent with the present disclosure, the enlarged head portion 254 can have other shapes, such as spherical shapes, cylindrical shapes, etc., and the adjacent track surfaces can have other shapes that may or may not reflect the shape of the enlarged head portion. In still further embodiments, interlocking guide members can include rollers or similar devices attached to the distal end of the first shaft portion 256*a* to function as the enlarged head portion 254. As the foregoing illustrates, the present invention is not limited to the particular interlocking guide assembly illustrated in FIG. 2, but extends to other embodiments incorporating the inventive features disclosed herein.

In yet another aspect of this embodiment, the second shaft portion 256*b* carries first and second coil springs 260*a, b* which are compressed against opposite sides of the second journal 258*b* and held in place by washers 264 and associated pins 262. The coil springs 260 permit the guide member 250 to move back and forth along the longitudinal axis 251 a preset distance, such as from about 0.1 inch to about 0.5 inch, e.g., about 0.25 inch. This movement enables the guide member 250 to accommodate minor misalignments in the second track section 114*b* without binding.

A first track bracket 270 fixedly attaches the second track section 114*b* to the wall 102. In one aspect of this embodiment, the track bracket 270 includes a recess 276 having a profile shape that at least approximates the cross-sectional shape of the second track section 114*b*. During sub-assembly of the vertical track segment 113 (FIG. 1), the track section 114*b* can be slid into the recess 276, and the track bracket 270 can be moved into a favorable position for attachment to the wall 102. The close-fitting shape of the recess 276 receives the second track section 114*b* and provides support for each of the operable surfaces thereof. In the illustrated embodiment, the track bracket 270 further includes a mounting flange 272 through which one or more fasteners 274 extend to fixedly attach the track bracket 270 to the wall 102. The fasteners 274 can include various types of bolts and/or other structural fasteners known in the art.

There are a number of advantages associated with the embodiments of the invention described above with reference to FIGS. 1 and 2. For example, one advantage is that the interlocking guide member 250 can eliminate the need for a spreader bar that spans between the opposing track assemblies 112 to help hold the tracks in position. The track brackets (e.g., the track bracket 270), can also increase the wind load capacity of the door 120. Yet another advantage of the embodiments described above is that the diverging guide surfaces 214 of the second track section 114*b* provides the door 120 with double knock-out capability (i.e., both inward and outward knock-out capability) for all but the upper-most door panel 122*a*.

Figure 3:
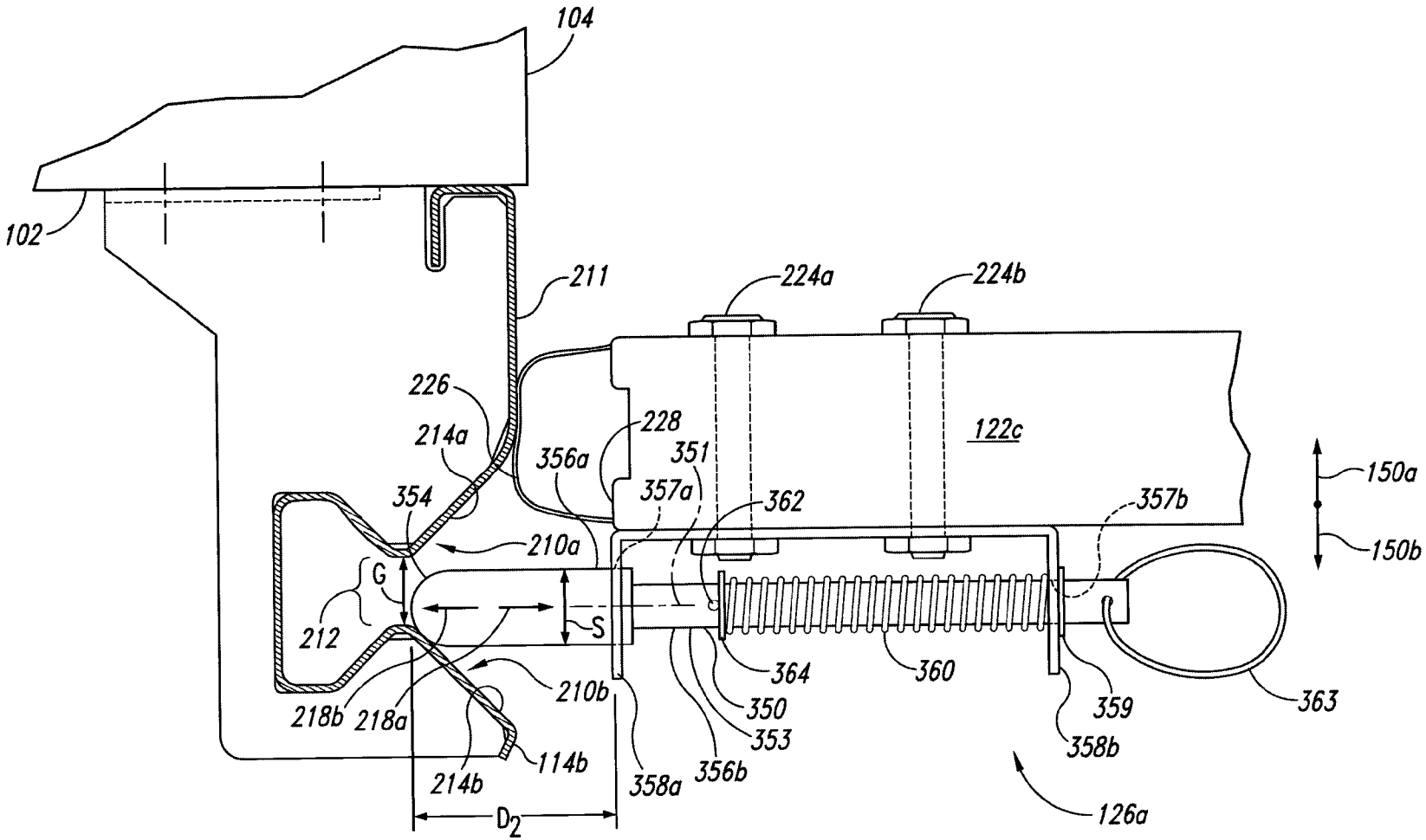
FIG. 3 is an enlarged cross-sectional end view of a track section and guide assembly configured in accordance with another embodiment of the invention.

FIG. 3 is an enlarged, cross-sectional end view taken along line 3-3 in FIG. 1, illustrating engagement of the releasable guide assembly 126*a* with the second track section 114*b*. The various track section and door panel features described above with reference to FIG. 2 apply to FIG. 3 as well. As can be seen from FIG. 3, however, in this particular embodiment the releasable guide assembly 126*a* includes a releasable guide member 350 that lacks the enlarged head portion 254 of the interlocking guide member 250 described above.

The releasable guide member 350 projects outwardly from the door edge region 228 along a longitudinal axis 351 which extends at least approximately parallel to the door panel 122*c*, and includes a cylindrical shaft 353 having a first shaft portion 356*a* and a smaller-diameter second shaft portion 356*b*. The first shaft portion 356*a* slidably extends through a first aperture 357*a* in a first journal 358*a*. The second shaft portion 356*b* extends from the first shaft portion 356*a* through a coaxial second aperture 357*b* in a second journal 358*b*. The second shaft portion 356*b* passes through a coil spring 360 that is compressed between the second journal 358*b* and a washer 364 which is held in place by a pin 362. The washer 364 and the pin 362 can be replaced with an E-ring or other type of suitable retainer.

The first shaft portion 356*a* has a constant, or at least approximately constant, diameter S until it reaches a hemispherical, or at least approximately hemispherical head portion 354. In the illustrated embodiment, the gap dimension G is smaller than the diameter S to prevent the first shaft portion 356*a* from protruding through the gap region 212 during door operation. If this were to happen, it could impede the knock-out capability of the releasable guide member 350. The first shaft portion 356*a*, or parts thereof, can be made from a suitable polymer material, such as plastic, Delrin®, Teflon®, etc. to reduce friction between it and the track section 114*b*.

The coil spring 360 urges the first shaft portion 356*a* outwardly in the sixth direction 218*b* toward the second track section 114*b*. An E-ring or other type of retainer 359 is fixedly attached to the second shaft portion 356*b*, however, to prevent the head portion 354 from projecting beyond a distance $D_2$ from the edge portion 228 of the door panel 122*c*. The distance $D_2$ is less than the distance $D_1$ discussed above with reference to FIG. 2, to prevent interference of the head portion 354 with the gap region 212 during normal operation of the door 120. As described in greater detail below, the coil spring 360 allows the head portion 354 to move inwardly in the fifth direction 218*a* a preset distance, such as from about 0.5 inches to about 1.5 inches, e.g., about 1.25 inches.

The releasable guide member 350 allows the third door panel 122*c* to be disengaged or "knocked-out" of the second track section 114*b* when a force of sufficient magnitude is exerted against the door panel 122*c* in the outward or first direction 150*a* or the inward or second direction 150*b*. For example, when the door panel 122*c* is subjected to a force of sufficient magnitude in the first direction 150*a*, the force causes the rounded head portion 354 of the guide member 350 to bear against the first guide surface 214*a*. The angle of the guide surface 214*a* causes the guide member 350 to retract inwardly in the fifth direction 218*a* as the door panel 122*c* continues moving outwardly in the first direction 150*a*. Once the head portion 354 is sufficiently retracted, the releasable guide member 350 moves free of the "V-groove" formed by the guide surfaces 214. The releasable guide assembly 126*a* can further include a D-ring or other type of pull feature 363 for manually retracting the releasable guide member 350 if desired to facilitate door panel installation, reinstallation, or removal.

Figure 4:
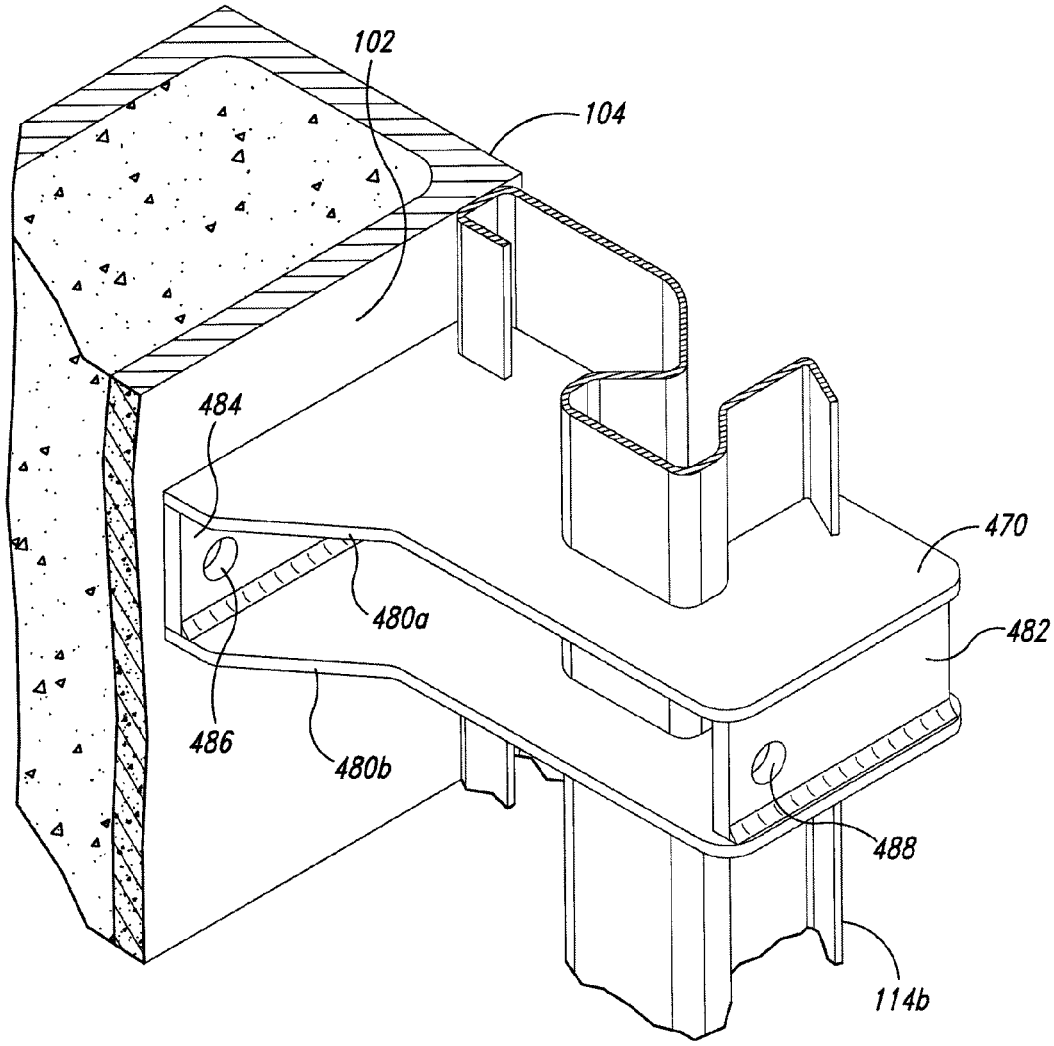
FIG. 4 is an enlarged isometric view of a door track support bracket configured in accordance with an embodiment of the invention.

FIG. 4 is an enlarged, cross-sectional isometric view of a track bracket 470 configured in accordance with another embodiment of the invention. The track bracket 470 includes a top plate 480*a* spaced apart from a bottom plate 480*b* by a first end plate 482 and a second end plate 484. The top and bottom plates 480, and the end plates 482 and 484, can be made from various types of steel, aluminum, and/or other suitable metallic and non-metallic materials known in the art. In the illustrated embodiment, the first end plate 482 and the second end plate 484 are welded to the top plate 480*a* and the bottom plate 480*b*. In other embodiments, however, the track bracket 470 can be manufactured by machining, casting, and/or other suitable forming techniques known in the art.

Many features of the track bracket 470 can be at least generally similar in structure and function to the track bracket 270 described above with reference to FIG. 2. For example, the second end plate 484 can include one or more apertures 486 or other provisions for fixedly attaching the track bracket 470 to the wall 102. In one aspect of this particular embodiment, however, the first end plate 482 can include a circular hole or other aperture 488 for receiving a slide lock (not shown) that is attached to the adjacent door panel. Providing the lock aperture 488 in the track bracket 470 eliminates the need for a similar hole in the adjacent portion of the track section 114. This reduces the manufacturing time and cost associated with the track section 114, and eliminates a void in the second track section 114 that can cause the door to knock or hang up during use.

A further benefit of the track brackets 270 and 470 described above is that they do not require any holes to be drilled or placed in the track section for mounting. In addition, these track brackets increase track section resistance to bending due to the increased section modulus. The increased bending stiffness facilitates proper track alignment and can prevent the tracks from spreading apart beyond the design tolerance required for proper door performance. Furthermore, these brackets can be positioned at virtually any location along the track.

Figure 5:
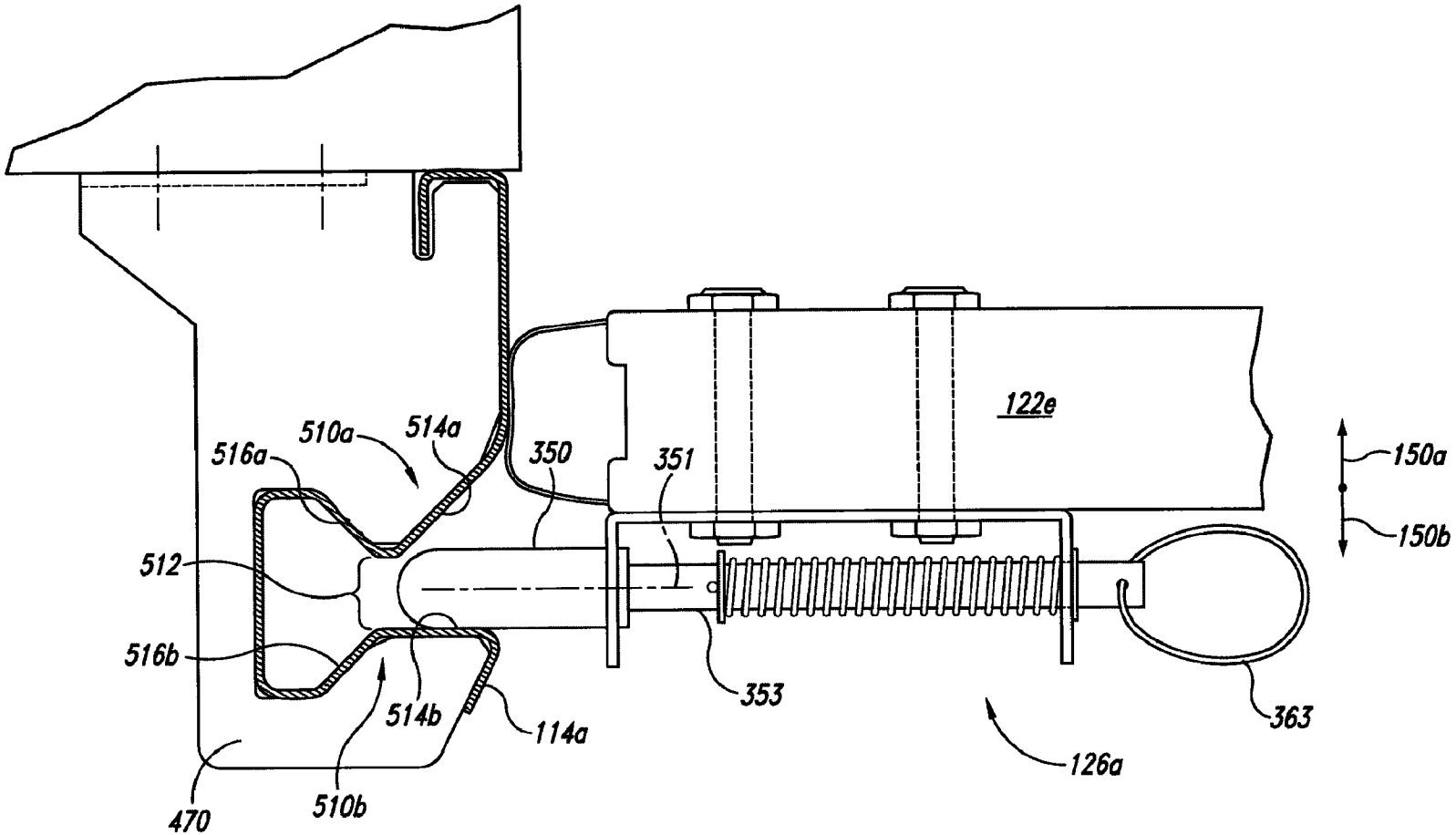
FIG. 5 is an enlarged cross-sectional end view of a track and guide assembly configured in accordance with a further embodiment of the invention.

FIG. 5 is an enlarged, cross-sectional end view taken along lines 5-5 in FIG. 1, showing the engagement of the releasable guide assembly 126*a* with the first track section 114*a*. Many features of the first track section 114*a* are at least generally similar in structure and function to corresponding features of the second track section 114*b* described above with reference to FIG. 2. For example, the first track section 114*a* includes a first side portion 510*a* spaced apart from a second side portion 510*b* to define a gap region 512 therebetween. Furthermore, the first side portion 510*a* includes a first guide surface 514*a* and a first retention surface 516*a* which are both oblique to the longitudinal axis 351 of the guide member 350. In one aspect of this particular embodiment, however, the second side portion 510*b* includes a second guide surface 514*b* that is at least approximately parallel to the longitudinal axis 351. The parallel guide surface 514*b* prevents the door panel 122*e* from being knocked out of the first track section 114*a* when struck with sufficient force in the second direction 150*b*. However, the oblique guide surface 514*a* still permits the door panel 122*e* to be disengaged from the first track section 114*a* when a force of sufficient magnitude is applied to the door panel 122*e* in the first direction 150*a*, or when an operator manually retracts the guide member 350 with the pull feature 363.

Figure 6A:
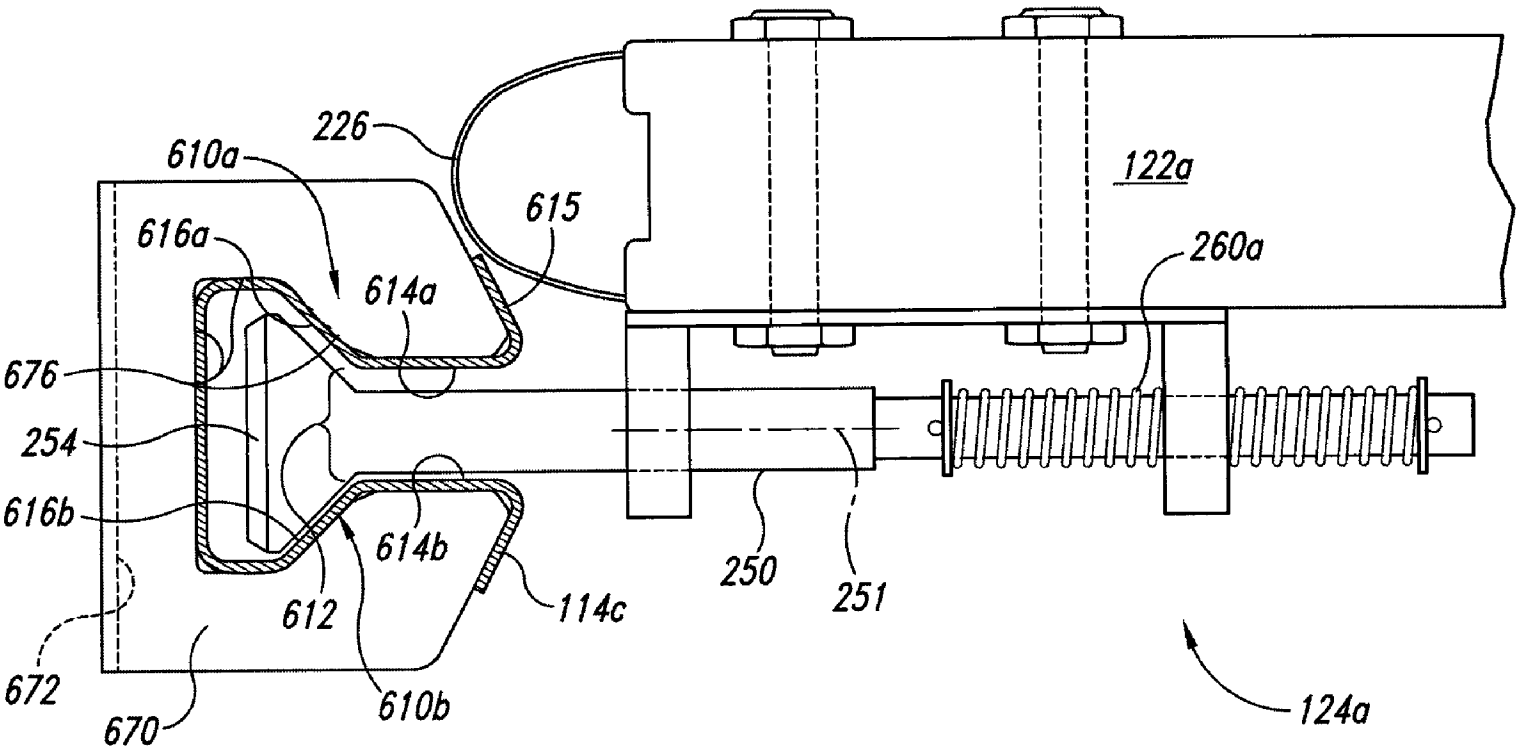
FIGS. 6A and 6B are enlarged cross-sectional end views of two different guide assemblies installed in another track section configured in accordance with an embodiment of the invention.
Figure 6B:
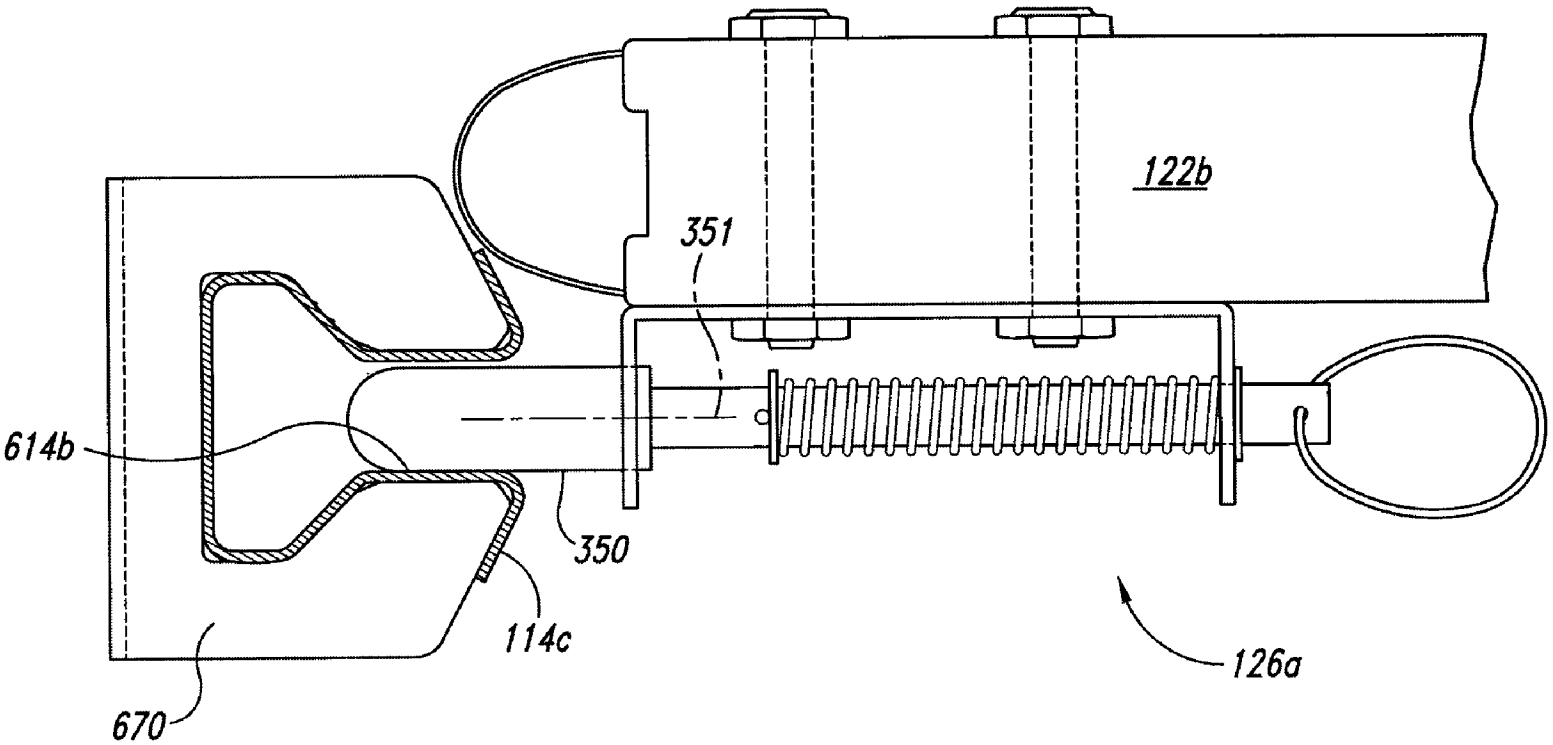

FIG. 6A is an enlarged, cross-sectional end view taken along line 6-6 in FIG. 1, showing the engagement of the interlocking guide assembly 124*a* with the third track section 114*c*. FIG. 6*b* is a similar view of the releasable guide assembly 126*a* engaged with the third track section 114*c*. For purposes of illustration, both of these views have been drawn with the door 120 (FIG. 1) in an overhead position.

Referring first to FIG. 6A, many features of the third track section 114*c* are at least generally similar in structure and function to corresponding features of the second track section 114*b* described above with reference to FIG. 2. For example, the third track section 114*c* includes a first side portion 610*a* spaced apart from a second side portion 610*b* to define a gap region 612 therebetween. Furthermore, each of the side portions 610 includes a corresponding retention surface 616 that is oblique to the longitudinal axis 251. More specifically, the retention surfaces 616 diverge inwardly from the gap region 612 to form a corresponding V-groove that movably receives the enlarged head portion 254 of the interlocking guide member 250. The retention surfaces 616 can be at least generally similarly in structure and function to the retention surfaces 216 described above with reference to FIG. 2. In one aspect of this particular embodiment, however, each of the side portions 610 further includes a corresponding guide surface 614 that is at least approximately parallel to the longitudinal axis 251 of the guide member 250.

As illustrated in FIG. 6B, the releasable guide member 350 extends outwardly from the second door panel 122*b* in parallel with the first and second guide surfaces 614 of the third track section 114*c*. Accordingly, in this embodiment, the second guide surface 614*b* provides a horizontal "shelf" that movably supports the door panel 122*b* as the door 120 (FIG. 1) moves into the overhead position. In addition, the parallel guide surfaces 614 can prevent the guide member 350 from being knocked out of the third track section 114*c*. In general, knock-out capability is not desirable when the door 120 is in the fully retracted, overhead position.

Returning to FIG. 6A, in another aspect of this embodiment, the third track section 114*c* further includes a return flange 615 extending adjacent to the first guide surface 614*a*. The return flange 615 is directed away from the door seal 226, instead of contacting the door seal 226 in the manner of the seal surface 211 illustrated in FIG. 2. By not contacting the door seal 226, the third track section 114*c* reduces the frictional forces on the door as it moves into the overhead position where sealing is not needed. In addition, directing the return flange 615 away from the door seal 226 can reduce the risk of damaging the seal 226 on the edge of the return flange 615.

A track bracket 670 is positioned on the third track section 114*c* and includes a stiffening flange 672. As with the track brackets 270 and 470 described above, the track bracket 670 can include a recess 676 having a profile that at least approximates the cross-sectional shape of the third track section 114*c*. By supporting the entire cross-section of the third track section 114*c*, the track bracket 670 can provide torsional support to the track section 114*c* without being fastened to the track section 114*c*. Furthermore, the lack of fasteners or other locating features enables the track bracket 670 to be positioned at virtually any desired location along the length of the third track section 114*c* during final assembly of the track. In those situations where additional track bracing may be needed, the track bracket 670 can be attached to a building structure via the flange 672.

Figure 7A:
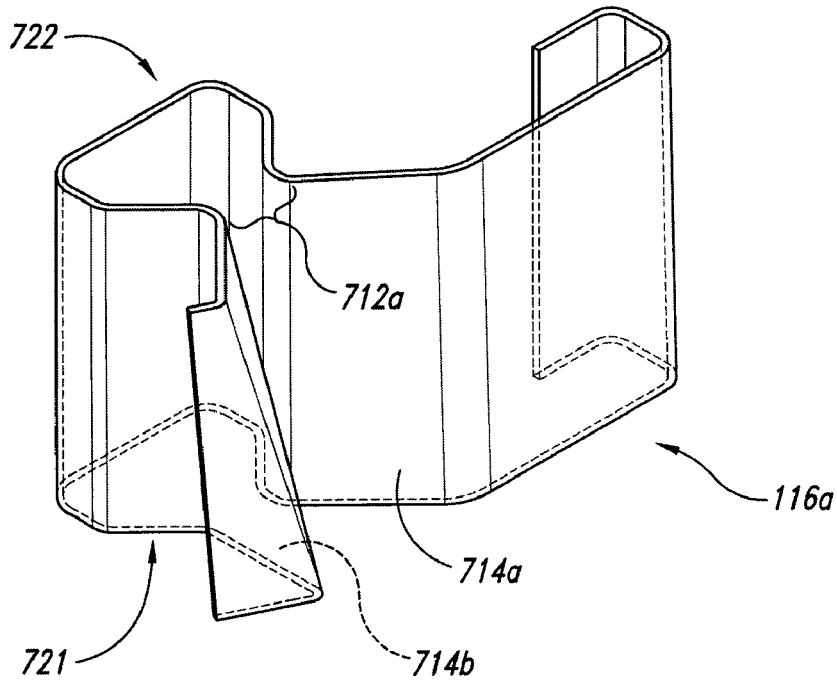
FIGS. 7A and 7B are enlarged isometric views of track sections for transitioning from a first track section to a second track section, in accordance with an embodiment of the invention.

FIG. 7A is an enlarged isometric view of the first transition section 116*a* of the first track assembly 112*a* described above with reference to FIG. 1. As shown in FIG. 1, the first transition section 116*a* transitions from the first track section 114*a* to the second track section 114*b*. To perform this function, the first transition section 116*a* includes a first guide surface 714*a* spaced apart from a second guide surface 714*b* to define a gap region 712*a* therebetween. At a first end 721 of the first transition section 116*a*, the guide surfaces 714 extend outwardly from the gap region 712*a* to give the transition section 116*a* a cross-sectional shape that at least approximately matches the cross-sectional shape of the first track section 114*a* described above with reference to FIG. 5. As the second guide surface 714*b* extends away from the first end 721 toward a second end 722, it twists away from the first guide surface 714*a*. At the second end 722, the guide surfaces 714 diverge outwardly from the gap region 712*a* to give the transition section 116*a* a cross-sectional shape that at least approximately matches the cross-sectional shape of the second track section 114*b* described above with reference to FIG. 2. Since, in one embodiment, the second track assembly 112*b* is essentially a mirror image of the first track assembly

112*a*, the second track assembly 112*b* will require a transition section that is a mirror image of the first transition section 116*a*.

Figure 7B:
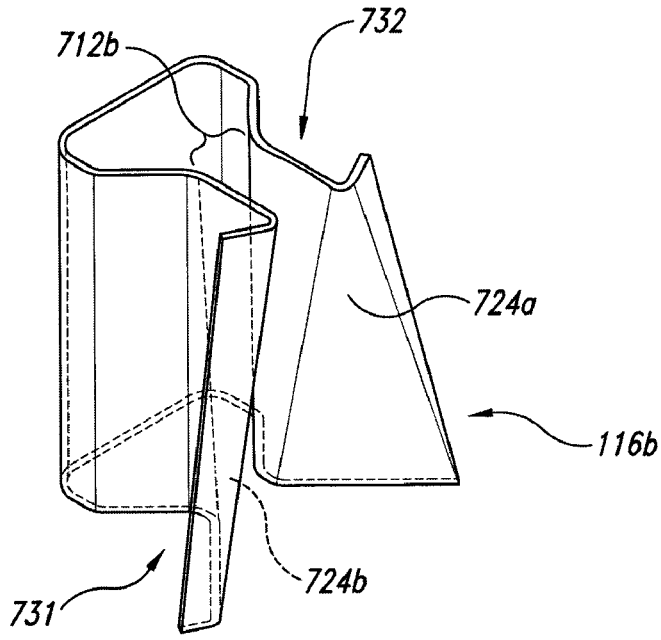

FIG. 7B is an enlarged isometric view of the second transition section 116*b* of the first track assembly 112*a* described above with reference to FIG. 1. As shown in FIG. 1, the second transition section 116*b* transitions from the second track section 114*b* to the third track section 114*c*. To perform this function, the second transition section 116*b* includes a first guide surface 724*a* spaced apart from a second guide surface 724*b* to define a gap region 712*b* therebetween. At a first end 731 of the second transition section 116*b*, the guide surfaces 724 diverge outwardly from the gap region 712*b* to give the transition section 116*b* a cross-sectional shape that at least approximately matches the cross-sectional shape of the second track section 114*b* described above with reference to FIG. 2. The guide surfaces 724 twist inwardly toward each other as they extend away from the first end 731 toward a second end 732. At the second end 732, the guide surfaces 724 extend outwardly from the gap region 712*b* in parallel to give the transition section 116*b* a cross-sectional shape that at least approximately matches the cross-sectional shape of the third track section 114*c* described above with reference to FIGS. 6A and 6B.

Figure 8:
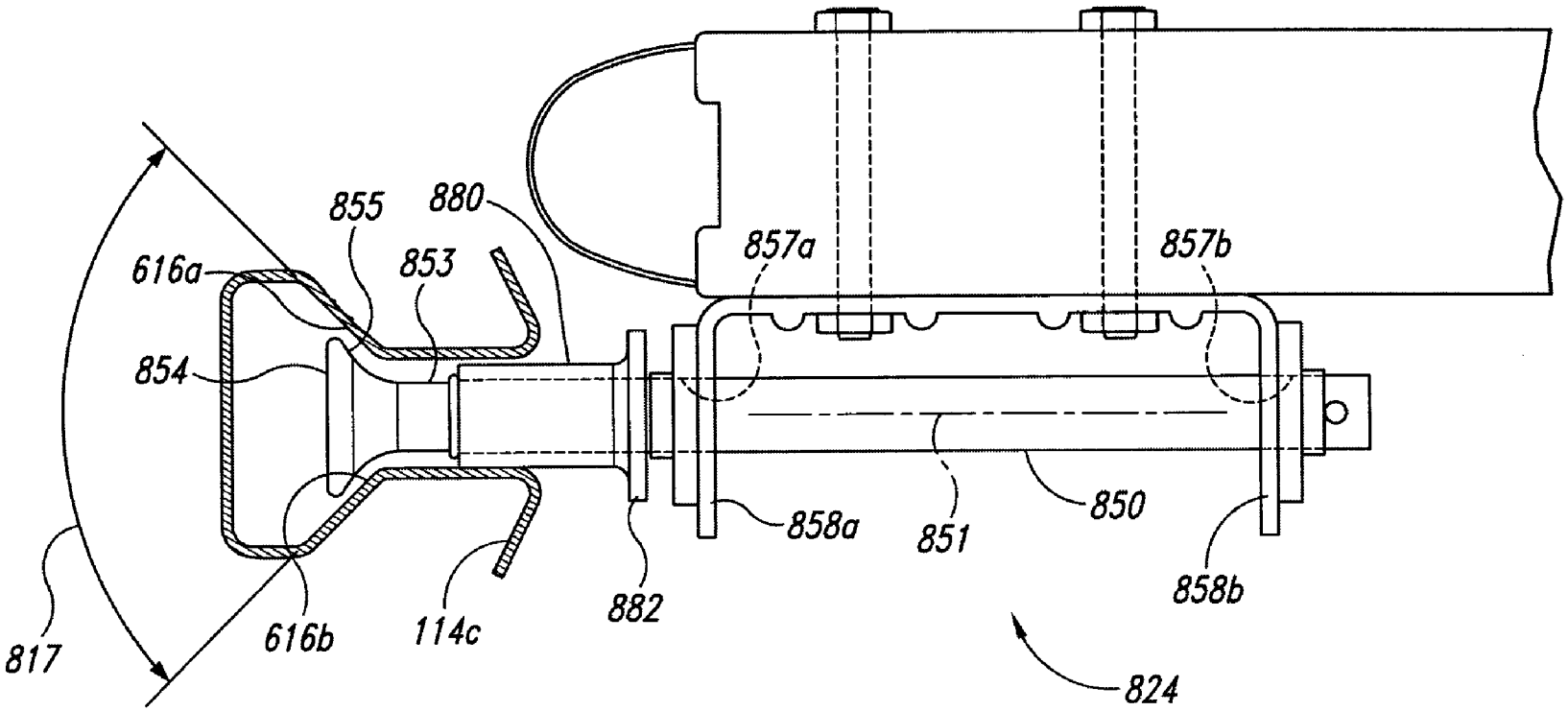
FIG. 8 is a cross-sectional end view of a track and guide assembly configured in accordance with another embodiment of the invention.

FIG. 8 illustrates an interlocking guide assembly 824 configured in accordance with another embodiment of the invention. Many features of the guide assembly 824 are at least generally similar in structure and function to corresponding features of the guide assembly 124*a* described in detail above with reference to FIG. 2. For example, the guide assembly 824 includes an interlocking guide member 850 having a cylindrical shaft 853 which carries an enlarged head portion 854. The enlarged head portion 854 flares outwardly from the cylindrical shaft 853 to form a reverse conical, or at least generally conical, surface 855 which is at least approximately parallel to an angle 817 between the retention surfaces 616 of the third track section 114*c*. In this embodiment, the angle 817 can be from about 90 degrees to about 150 degrees, e.g., about 120 degrees. One advantage of the 120 degree head angle of this embodiment is that it may provide manufacturing advantages as compared to other head angles.

In another aspect of this embodiment, the cylindrical shaft 853 is supported by a first bearing 857*a* (e.g., a ball or roller bearing) carried by a first journal 858*a*, and a second bearing 857*b* carried by a second journal 858*b*. The bearings 857 can facilitate rotation of the cylindrical shaft 853 about a guide member longitudinal axis 851.

In a further aspect of this embodiment, the guide assembly 824 also includes a collar 880 which is rotatably disposed on the cylindrical shaft 853. The collar 880 can eliminate or at least reduce the need for the springs 260 discussed above with reference to FIG. 2. For example, the collar 880 can include a flange 882 that bears against the inboard edges of the track section 114*c* when the opposing track assemblies 112*a* and 112*b* (FIG. 1) are positioned too close together making the track spacing too narrow. Conversely, if the track spacing is too wide, the conical surface 855 of the enlarged head portion 854 will rub against the retention surfaces 616, causing the operational forces on the door to increase. This can serve as notification to maintenance personnel that the door tracks may be misaligned and require service. The collar 880 can be manufactured from a polymer, a metal, or any other material having suitable structural characteristics.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

I claim:

1. A track assembly for use with an overhead door, the overhead door having at least one guide member extending outwardly therefrom along a longitudinal axis, the track assembly comprising:

a first track section, the first track section including:

a first side portion having a first guide surface positioned at an oblique angle to the longitudinal axis of the guide member; and a second side portion having a second guide surface, wherein the second guide surface is spaced apart from the first guide surface to form a V-groove configured to movably receive the overhead door guide member; and a second track section operably coupled to the first track section, the second track section including:

a third side portion having a third guide surface and a first retention surface, wherein the first retention surface is positioned at an oblique angle to the longitudinal axis of the guide member; and a fourth side portion spaced apart from the third side portion to define a gap region therebetween, the fourth side portion having a fourth guide surface and a second retention surface, wherein the second retention surface is positioned at an oblique angle to the longitudinal axis of the guide member;

wherein the third and fourth guide surfaces extend from the gap region in a first direction and movably receive the overhead door guide member, and wherein the first and second retention surfaces diverge from the gap region in a second direction, opposite to the first direction.

2. The track assembly of claim 1 wherein the second guide surface is positioned at an oblique angle to the longitudinal axis of the guide member.

3. The track assembly of claim 1 wherein the second guide surface is at least approximately parallel to the longitudinal axis of the guide member.

4. The track assembly of claim 1 wherein the fourth guide surface is at least approximately parallel to the longitudinal axis of the guide member.

5. The track assembly of claim 1 wherein the third and fourth guide surfaces are at least approximately parallel to the longitudinal axis of the guide member.

6. The track assembly of claim 1 wherein the second guide surface is at least approximately parallel to the fourth guide surface.

7. The track assembly of claim 1 wherein the second guide surface is at least approximately parallel to the third and fourth guide surfaces.

8. The track assembly of claim 1 wherein the third guide surface is at least approximately parallel to the fourth guide surface, and wherein the first retention surface is disposed at an angle of from about 40 degrees to about 180 degrees relative to the second retention surface.

9. The track assembly of claim 1 wherein the third side portion further includes a first corner region positioned between the third guide surface and the first retention surface, wherein the fourth side portion further includes a second corner region positioned between the fourth guide surface and the second retention surface, and wherein the first and second corner regions define the gap region.

10. The track assembly of claim 1 wherein the overhead door guide member is a first guide member, and wherein the gap region between the third and fourth side portions is configured to movably receive a second overhead door guide member, different than the first overhead door guide member.

11. The track assembly of claim 1, further comprising a seal surface extending away from the third guide surface at an angle, wherein the seal surface is configured to slidably contact an overhead door seal.

12. An overhead door assembly for use with an opening in a building, the overhead door assembly comprising:

a track configured to be mounted to the building proximate the opening, the track including:

a first side portion having a first guide surface and a first retention surface; and a second side portion having a second guide surface and a second retention surface, wherein the second side portion is spaced apart from the first side portion to define a gap region therebetween, wherein the first and second guide surfaces extend outwardly from the gap region toward a first direction, and wherein the first and second retention surfaces diverge inwardly from the gap region toward a second direction, opposite to the first direction;

a first door panel having a first side edge spaced apart from a second side edge;

a first guide assembly attached to the first door panel proximate to the first side edge, wherein the first guide assembly includes a first guide member that movably extends through the gap region of the track, and wherein the first guide member includes a first head portion configured to be movably retained by the first and second retention surfaces, wherein the first head portion is spaced apart from the first side edge by a first offset distance;

a second door panel having a third side edge spaced apart from a fourth side edge, wherein the second door panel is hingably attached to the first door panel; and a second guide assembly attached to the second door panel proximate to the third side edge, wherein the second guide assembly includes a second guide member having a second head portion configured to be movably received between the first and second guide surfaces, and wherein the second head portion is spaced apart from the third side edge by a second offset distance that is less than the first offset distance.

13. The overhead door assembly of claim 12 wherein the first guide member extends outwardly from the first door panel along a longitudinal axis, and wherein the first guide surface is at least approximately parallel to the longitudinal axis.

14. The overhead door assembly of claim 12 wherein the first guide member extends outwardly from the first door panel along a longitudinal axis, and wherein the first and second guide surfaces are at least approximately parallel to the longitudinal axis.

15. The overhead door assembly of claim 12 wherein the first guide surface is at least approximately parallel to the second guide surface.

16. The overhead door assembly of claim 12 wherein the first and second retention surfaces form a V-groove extending away from the gap region in the second direction.

17. The overhead door assembly of claim 12 wherein the first head portion of the first guide member is larger than the second head portion of the second guide member.

18. The overhead door assembly of claim 12 wherein the first head portion of the first guide member has a first diameter, and wherein the second head portion of the second guide member has a second diameter, smaller than the first diameter.

19. The overhead door assembly of claim 12 wherein the gap region defines a gap dimension, wherein the second head portion of the second guide member has a diameter that is greater than the gap dimension.

20. The overhead door assembly of claim 12 wherein the first head portion is operably positioned to one side of the gap region proximate the first and second retention surfaces, and wherein the second head portion is operably positioned to an opposite side of the gap region proximate the first and second guide surfaces.

* * * * *

UNITED STATES PATENT AND TRADEMARK OFFICE

CERTIFICATE OF CORRECTION

PATENT NO. : 8,297,333 B2
APPLICATION NO. : 12/976807
DATED : October 30, 2012
INVENTOR(S) : Michael M. Meichtry It is certified that error appears in the above-identified patent and that said Letters Patent is hereby corrected as shown below:

On Title page, in "Assistant Examiner", in column 2, line 1, Delete "Jamie" and insert -- Jaime --, therefor.

Signed and Sealed this
Nineteenth Day of February, 2013

Teresa Stanek Rea

Teresa Stanek Rea
*Acting Director of the United States Patent and Trademark Office*